US005765392A

United States Patent [19]

Baur

[11] Patent Number: 5,765,392

[45] Date of Patent: Jun. 16, 1998

[54] SCREW COMPRESSOR APPARATUS FOR REFRIGERANTS WITH OILS SOLUBLE IN REFRIGERANTS

[75] Inventor: Ferdinand Baur, Nonnenhorn, Germany

[73] Assignee: Sulzer-Escher Wyss GmbH, Lindau, Germany

[21] Appl. No.: 692,684

[22] Filed: Aug. 6, 1996

[30] Foreign Application Priority Data

Aug. 9, 1995 [EP] European Pat. Off. ..... 95810503

[51] Int. Cl.[6] ..... F25B 43/02; F01C 21/04

[52] U.S. Cl. ..... 62/473; 62/84; 418/97; 418/DIG. 1

[58] Field of Search ..... 62/192, 84, 473, 62/469; 418/DIG. 1, 97

[56] References Cited

U.S. PATENT DOCUMENTS 4,497,185 2/1985 Shaw ..... 62/473

FOREIGN PATENT DOCUMENTS 0 030 275 6/1981 European Pat. Off. .

0 030 619 6/1981 European Pat. Off. .

2801408 7/1979 Germany .

0926454 5/1982 U.S.S.R. ..... 62/473

WO83/03641 10/1983 WIPO .

*Primary Examiner*—William E. Wayner

*Attorney, Agent, or Firm*—Townsend and Townsend and Crew LLP

[57] ABSTRACT

The invention shows an improvement in the lubrication of bearings and shaft seals of screw compressors for refrigerants with oils soluble in refrigerants. A typical application results, for example, for ammonia with polyalkylene glycol soluble therein. Due to the fact that a partial oil flow is taken out of the oil flow returned to the screw compressor at an intermediate pressure prior to a pressure reduction to nearly suction pressure of the compressor and conveyed via a vapor separation container, substantial proportions of the dissolved refrigerant can be fed in at an intermediate pressure connection on the compression path of the screw compressor. Correspondingly more advantageous are the lubrication properties of the remaining partial oil flow at the lubrication connection, and the disadvantages of pressure collapse or foam conveyance at an oil pump are absent, since no oil pump is required with a suitable intermediate pressure.

11 Claims, 5 Drawing Sheets

24
20
23
11
15
19
17
2
30
14
16
31
1
29
10
25
3a
18
3
32
3b
35
4
5
34
9
33
8
7
6

SCREW COMPRESSOR APPARATUS FOR REFRIGERANTS WITH OILS SOLUBLE IN REFRIGERANTS

BACKGROUND OF THE INVENTION

The invention relates to a screw compressor apparatus for refrigerants with oils soluble in refrigerants, for example for ammonia with polyalkylene glycol soluble therein, where a delivery flow is divided after a screw compressor in an oil separator standing under exit pressure into a gas flow and an oil flow and the oil flow enters the screw compressor via a throttle point and an oil inlet.

In screw compressors two screw-formed rotors, main and auxiliary rotors, rotate in a housing. During the suction process the tooth gap between the rotors increases during rotation and gas is sucked in. On further rotation of the rotors this tooth gap closes when running over the intake control edge. On further rotation the counter rotor engages into the gap and continuously reduces the enclosed gas space; the gas is condensed until the outlet control edge is finally reached, and the compressed gas is expelled.

In the compression chamber a relatively large amount of oil is injected into the gas flow to be conveyed in order to obtain a better seal and hence an improvement of the degree of delivery and in order to carry off a part of the heat of compression with the oil. This oil must be separated out of the gas stream at the pressure side of the compressor by an oil separator because it would otherwise load the refrigerant circuit in an undesired manner.

FIG. 1 shows such a known apparatus:

A gas flow 30 permeated with oil particles is conveyed by the screw compressor 1 via a pressure line 2 to an oil separator 3. From there the de-oiled gas flow 31 is conveyed to a liquefier in the sense of the refrigerant circuit process. The oil separated out in the oil separator 3 arrives via a line 4 at a water or air cooled oil cooler 5 in which the heat of compression is carried off. The oil is again fed to the compressor 1 via a line 6, an oil filter 7, a non-return valve 8, a solenoid valve 9 and an oil inlet 10. As a rule the pressure difference between the compression and suction sides of the compressor is made use of for the forwarding of the oil. A portion of this returned oil is used for the lubrication of the bearings and in so-called "open" compressors, in which the drive shaft is led outwards, for the lubrication and cooling of the shaft seal. The rotating shaft seal serves to seal off the compressor drive shaft from the atmosphere.

Previously, for example, $NH_3$ refrigerant apparatuses were operated almost exclusively with so-called overflooded evaporators and with $NH_3$-insoluble mineral oils. These mineral oils were not able to become enriched with $NH_3$ due to its insolubility, so that nearly pure oil was again available for lubricating the bearings and the shaft seal. In $NH_3$ screw compressors the supply of the shaft seal and the drive-side bearing lying on the suction side with lubrication oil has become problematic, since in recent times such screw compressor refrigeration apparatuses have increasingly been operated with $NH_3$-soluble oil, a polyalkylene glycol, called PAG oil for short. These $NH_3$-soluble oils are a prerequisite for a so-called dry expansion vaporization, by which the amount of $NH_3$ to be filled into the refrigeration circuit can be considerably reduced in contrast to the overflooded operation. As a result of the accident prevention regulations currently in effect, great efforts are being expended in modern refrigeration technology to manufacture $NH_3$-refrigeration apparatuses with the smallest possible filling quantities.

The $NH_3$-soluble oils become enriched with a certain amount of $NH_3$ due to the solubility behavior in accordance with the pressure and temperature conditions given in the oil separator, at a normal operating point, e.g. with approximately 6% $NH_3$ in the oil. For the oil supply of the shaft seal and the drive-side bearing the oil is relaxed to suction pressure. The take-up capacity of the oil for $NH_3$ thereby decreases at a normal operating point, e.g. to approximately 3% $NH_3$ in the oil, so that the difference of approximately 3% $NH_3$ necessarily evaporates out of the oil. Due to the very large volume of $NH_3$ vapor a large volume of oil foam arises through this outgassing process (at a normal operating point approximately 11 times the volume compared with the pure oil), the lubrication effect of which is very much smaller compared with the pure oil. This consequently often leads to very rapid wear of the shaft seal and in part also of the drive-side bearing due to insufficient lubrication. Devices are known which remedy this condition to a limited extent.

FIG. 2 shows a known apparatus for oils soluble in refrigerants in screw compressors which relaxes the oil provided for lubrication and sealing via a throttle point 25 and conducts it via a vapor separation container 21, the vapor chamber of which is in connection with the suction side 29 of the screw compressor 1 via a line 12. The oil is thereby "degassed" and can be fed to the shaft seal and the drive-side bearing with better lubricating effect, with the required pressure difference being produced by an oil pump 13. This arrangement has the disadvantage that the screw compressor depends on the proper functioning of an oil pump during its operation. A further disadvantage is that during start-up of such a screw compressor apparatus the oil behind the throttle point 25 foams up and partly arrives at the lubrication points as foam.

SUMMARY OF THE INVENTION

The object of the invention is to improve the above conditions.

This object is satisfied by branching off a partial oil flow via a branch ahead of the throttle point for the lubrication of bearings and/or shaft seals and passing it through a vapor separation container which is connected at the gas-side via a line to an intermediate pressure connection on the compression path of the screw compressor, in order to feed the partial oil flow to a lubricating connection at the screw compressor at a pressure corresponding to the intermediate pressure.

This arrangement has the advantage that the lubrication pressure does not collapse during the rundown of the screw compressor in the case of a power failure since the pressure difference between the end pressure and the intermediate pressure then diminishes slowly if at all after the screw compressor comes to rest. Moreover, no oil pump is necessary. In addition, the vapor led off from the lubricating oil is in-fed under intermediate pressure so that its compression from suction pressure to intermediate pressure can be dispensed with and thereby the refrigeration efficiency of the circuit is improved.

Further advantageous developments of the invention are shown in the dependent claims 2 to 8. Thus it proved advantageous, in addition to the intermediate pressure, to adjust the partial oil flow with a throttle or a control member. In addition it is of advantage to heat the oil in the vapor separation container in order to drive out more gas at a higher temperature with lower gas solubility. The reduction of the gas content is more than sufficient compensation for the lowered viscosity in order to obtain an adequate lubrication. In addition one could still cool the partial oil flow between the vapor separation container and the lubrication points in order to obtain a higher viscosity while hardly driving out gas due to the higher solubility even upon reduction of the pressure at the lubrication points. Furthermore, it is advantageous for start-up and for the further operation to mount the vapor separation container above the screw compressor and to prevent an emptying of the vapor separation container and of the feed line in the stationary state by blocking valves in order to have at least the geodetic head available. If the pressure difference between the end pressure and intermediate pressure is too small in the start-up phase, an oil pump can also be provided after the vapor separation container, which is switched off after start-up, i.e. when a sufficient pressure difference has built up.

Many of the screw compressor constructions have the possibility of additionally sucking a secondary gas flow into the already partially compressed gas. An opening in the housing is placed in such a manner that an average pressure of the suction and end pressure is attained in the tooth gap at this point. In a two stage relaxation the gas of the first relaxation stage is sucked in via this opening into the compression chamber. With this "economizer circuit" the efficiency of the refrigeration apparatus is improved. An advantage of the above apparatus is that the screw compressors which have such an economizer connection need not be modified in construction in order to make use of the apparatus.

BRIEF DESCRIPTION OF THE DRAWINGS

In the following the invention will be explained on the basis of exemplary embodiments.

DESCRIPTION OF THE PREFERRED EMBODIMENTS

An improvement of the lubrication of bearings and shaft seals of screw compressors for refrigerants with refrigerant soluble oils is shown in the Figures. A typical application results for example for ammonia with polyalkylene glycol soluble therein. Due to the fact that a partial oil flow is removed from the oil flow returned to the screw compressor at an intermediate pressure prior to the pressure reduction to approximately compressor suction pressure and guided through a vapor separation container, substantial proportions of dissolved refrigerant can be fed in at an intermediate pressure connection on the compression path of the screw compressor. Correspondingly more advantageous are the lubrication properties of the remaining oil flow at the lubrication connection, and the disadvantages of pressure collapse or conveying foam by an oil pump are absent since no oil pump is required with a suitable intermediate pressure.

Figure 1:
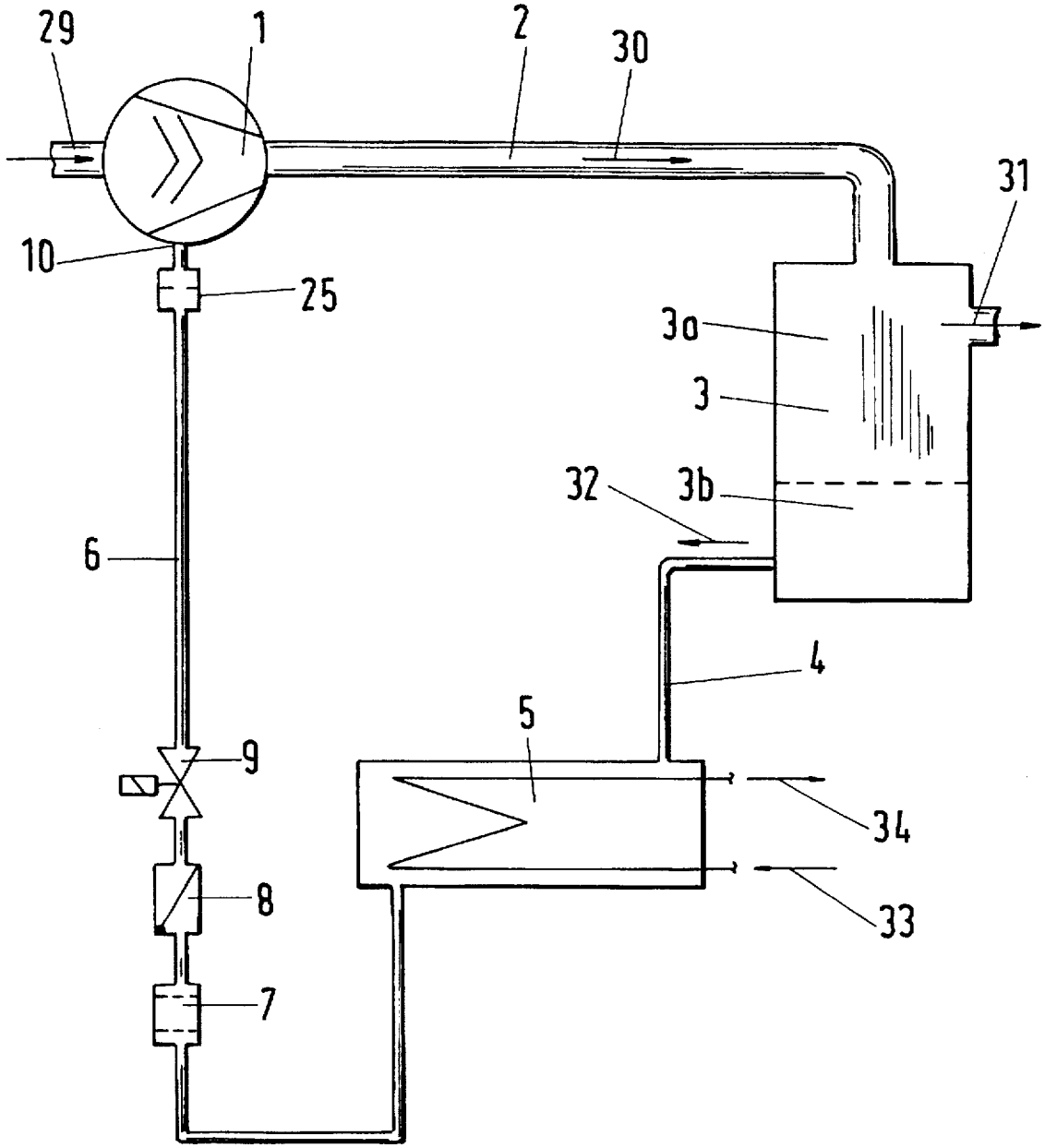
FIG. 1 schematically illustrates an apparatus of prior screw compressors for refrigerants with oils soluble in the refrigerants.
Figure 2:
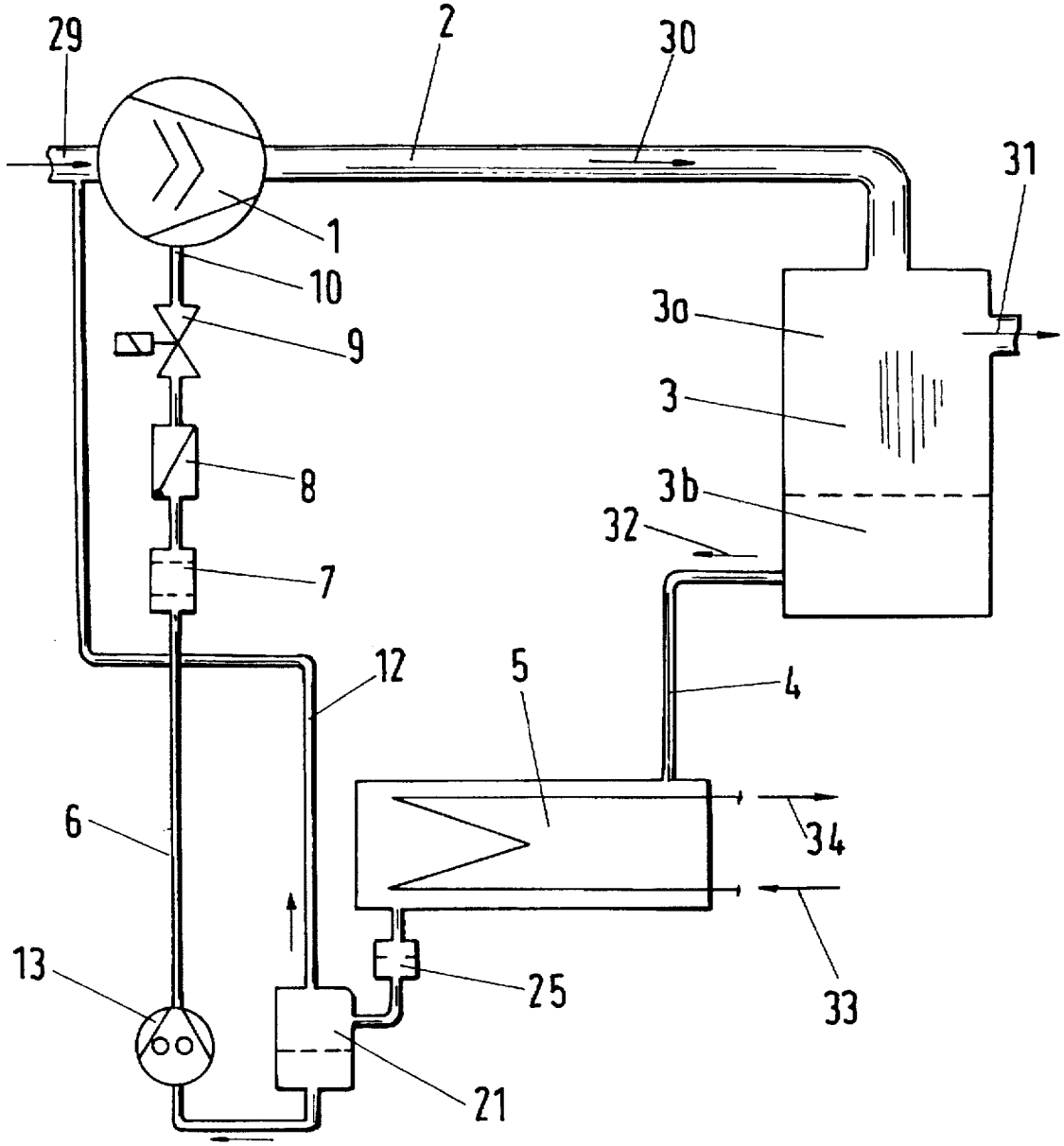
FIG. 2 schematically illustrates an apparatus as in FIG. 1 with an additional vapor separation container and with an auxiliary oil pump.
Figure 3:
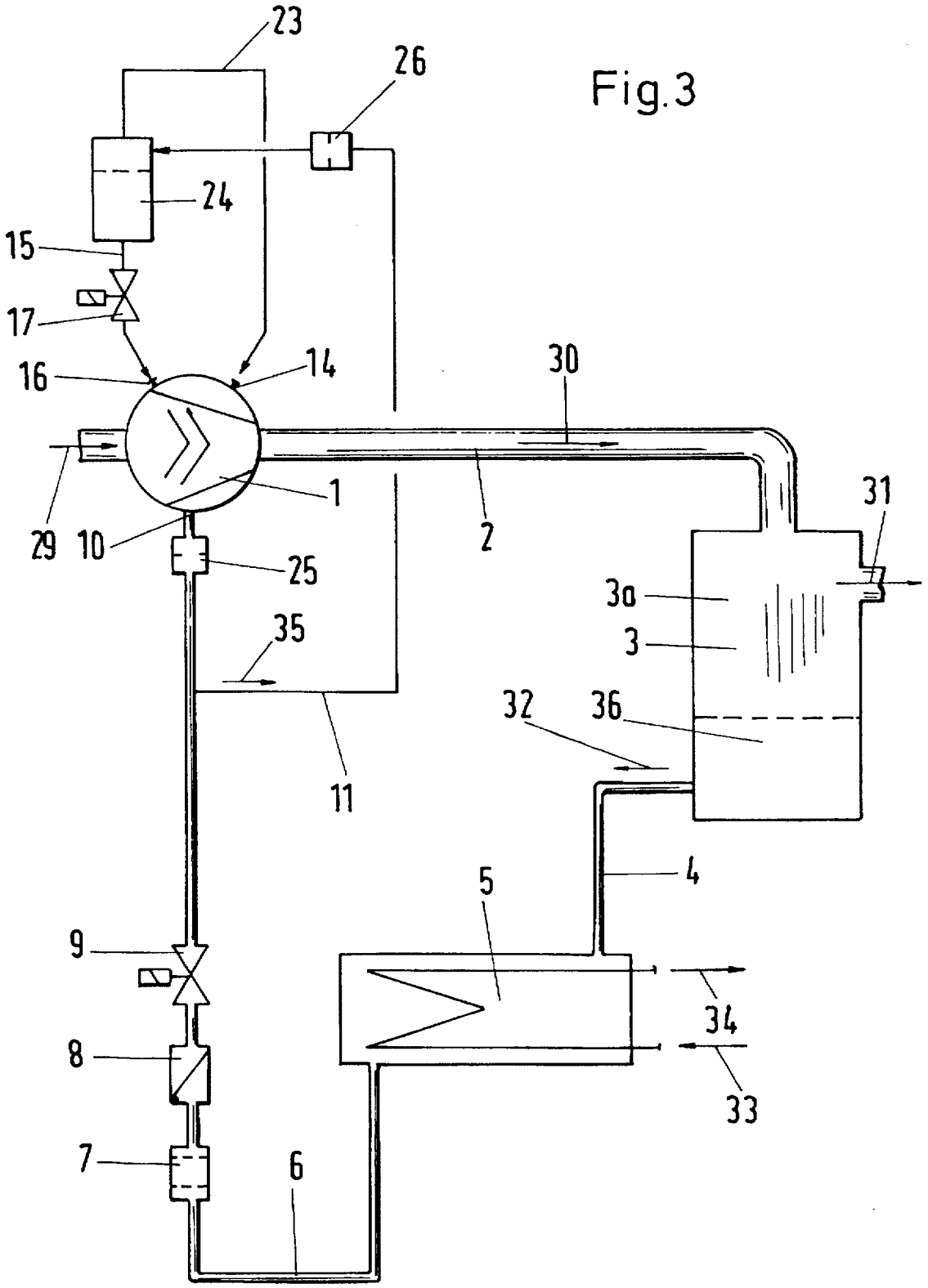
FIG. 3 schematically illustrates an apparatus in accordance with the invention in which a partial oil flow is extracted after passing through an oil cooler.
Figure 4:
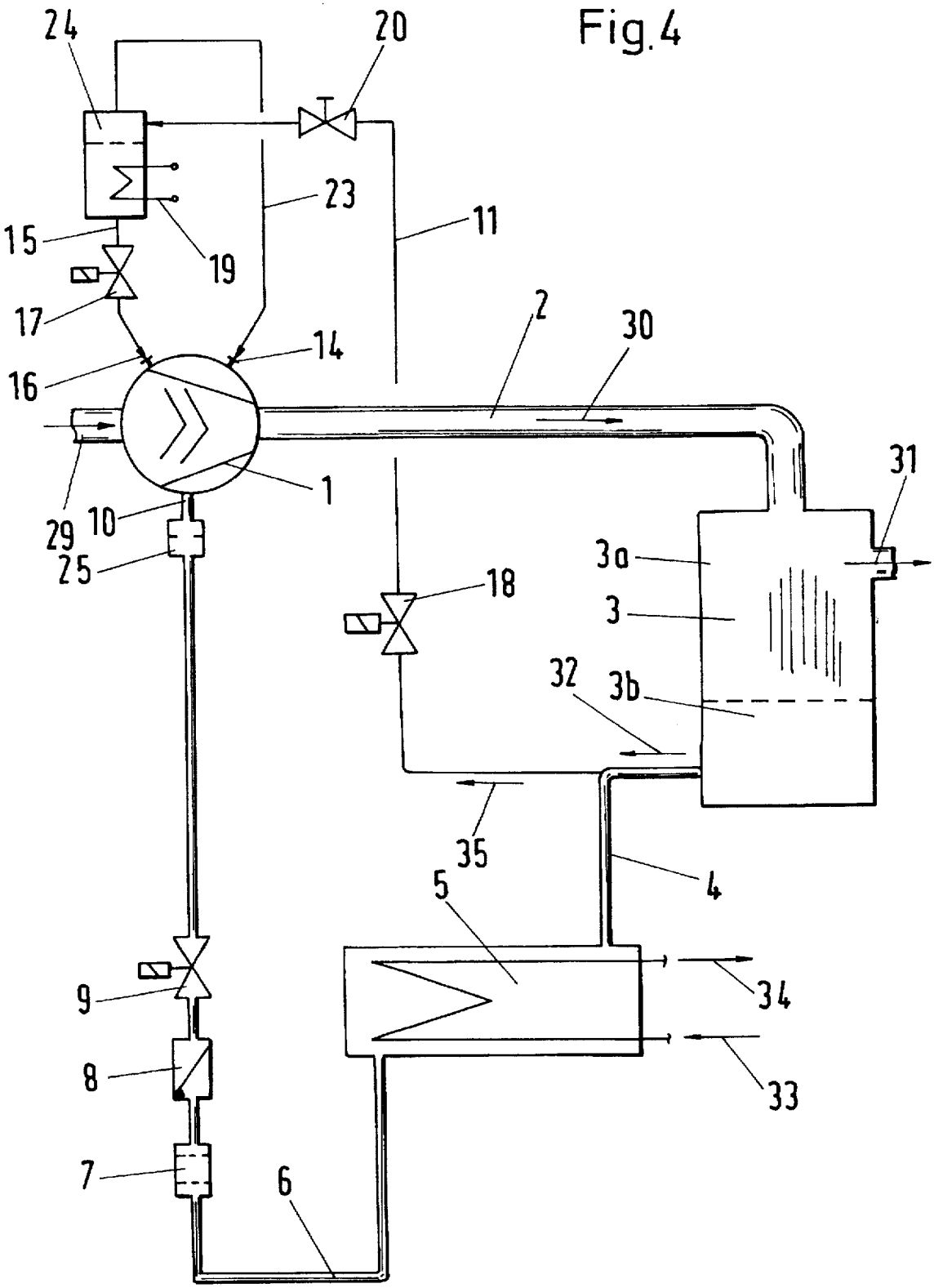
FIG. 4 schematically illustrates an apparatus in accordance with the invention in which a partial oil flow is extracted uncooled before the oil cooler.
Figure 5:
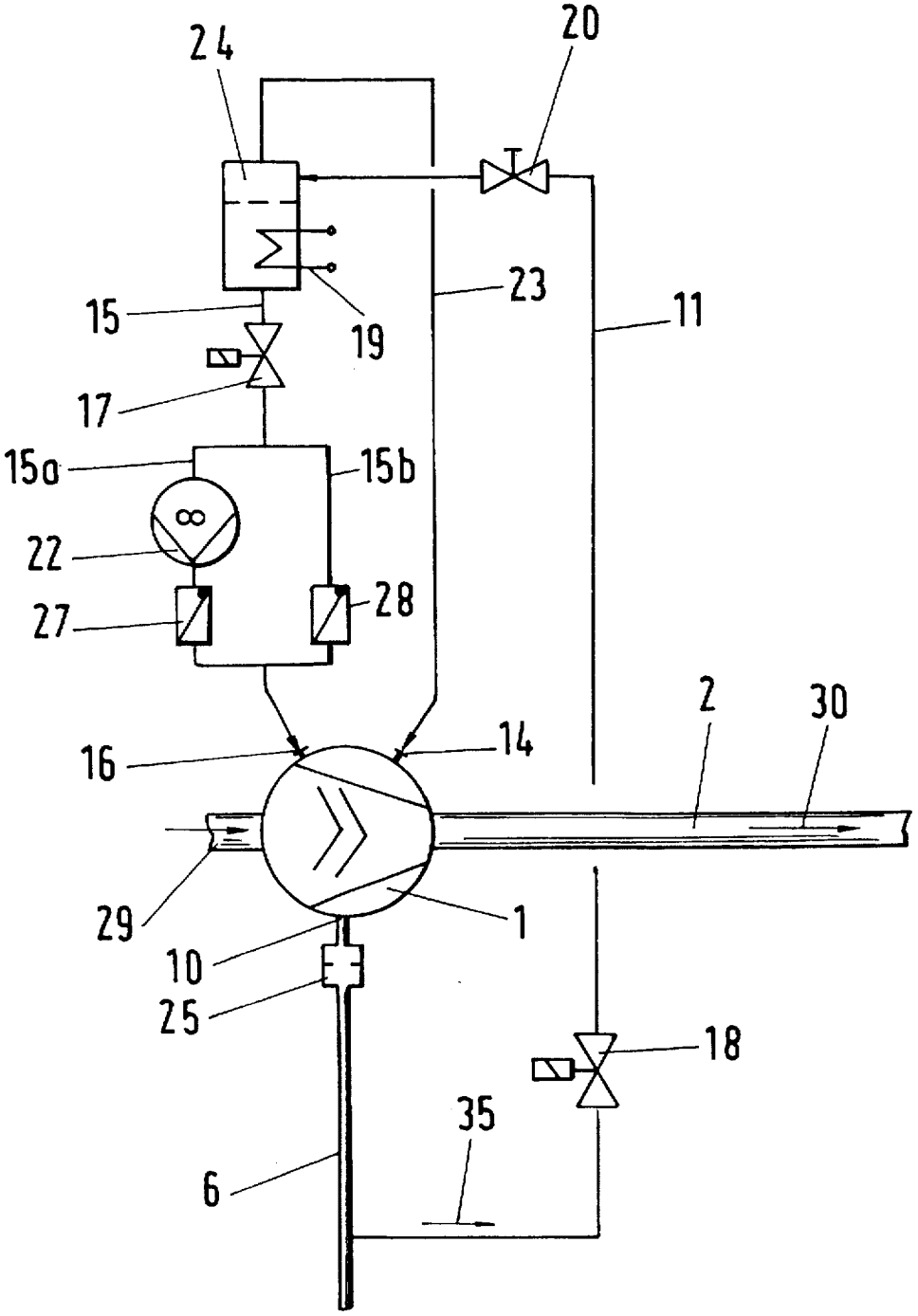
FIG. 5 schematically illustrates an apparatus analogous to FIG. 3 in which an auxiliary pump assists the lubrication during start-up of the screw compressor.

In FIG. 3 a screw compressor 1 forwards ammonia in gaseous form out of a suction line 29 and compresses it, while polyalkylene glycol is injected at an oil inlet 10 in order to improve the sealing effect between the compression chambers. A throttle point 25 is drawn in symbolically for the resistance of the nozzles or apertures during injection. The forwarded flow 30 exiting against an end pressure from the screw compressor 1 is fed via a pressure line to an oil separator 3 which has a gas chamber **3*a* from which a gas flow 31 is supplied to a non-illustrated liquefier, while an oil supply 3*b* is present at the base of the oil separator 3 from which an oil flow 32 is led via a line 4 through an oil cooler 5. The cooled oil flow 32 passes in a line 6 via an oil filter 7, a non-return valve 8 and a solenoid valve 9 to the throttle point 25 and the oil inlet 10. Prior to the throttle point 25 a partial oil flow 35 is branched off in a branch 11 for the lubrication of bearings and shaft seals and led into a vapor separation container which has the pressure of an intermediate pressure connection 14 on the compression path of the screw compressor 1. The pressure at the entry into the branch 11 must thus be somewhat higher than the pressure at the intermediate pressure connection 14 in order to limit the partial oil flow 35 by an aperture 26. In the vapor separation container 24 an outgassing of ammonia takes place by virtue of the dwell time in the container and of the low pressure zones at the edges of the aperture 26, and thus ammonia is fed to the intermediate pressure connection 14 via a line 23. The outgassing can be assisted by a heater device 19 as shown in FIGS. 4 and 5. The degassed partial oil flow arrives via a line 15 and a solenoid valve 17 at a lubrication connection 16 and after passing through bearings and shaft seals passes back into the gas flow in a suction chamber 29 at the compressor inlet. A so-called economizer connection on the screw compressor 1 is used as a intermediate pressure connection. This "economizer" connection is present on every modern screw compressor and opens into the screw compressor at a position of the compression path at which the suction chamber is already closed by the screw profiles. The quantity of gas fed in at this position thus no longer places a load on the gas volume sucked in and is thus for the most part power neutral. In addition, at the economizer connection 14**, there is a pressure of approximately 1.5 to 2 bars greater than at the shaft seal of the compressor which is at suction pressure, so that this pressure difference can be exploited for the forwarding of oil and an oil pump can in most cases be dispensed with.

The vapor separation container 24 is mounted above the screw compressor 1 and the solenoid valve 17 is closed in the stationary state in order to have an oil reserve running in under gravitation on start-up.

In FIG. 5 the circuit of the partial oil flow 35 has simply been augmented by further components relative to FIG. 3. A solenoid valve 18 is provided in the branch 11 which prevents a backflow of oil from the higher lying regions at standstill, and the partial oil flow 35 is limited by a control valve 20 which, for example, holds the oil level in the vapor separation container 24 constant. A heater device 19 promotes the outgassing of the refrigerant. The line 15 forks after the solenoid valve 17 into a branch **15*a* into which an oil pump 22 with non-return valve 27 is built as an aid to starting up, and into a branch 15*b* with a non-return valve 28 in order to feed past the turned off oil pump 22 into the lubrication connection 16. Such a pressure increasing pump 22 could always be kept running if the intermediate pressure is insufficient for the lubrication. The regulating valve 20 would then feed on the partial oil flow 35 in accordance with the delivery capacity of the pump 22**.

In contrast to FIGS. 3 and 5, FIG. 4 shows an arrangement in which the branch 11 for the partial oil flow 35 splits off before the oil cooler 5. The partial oil flow is admitted in considerably hotter form into the vapor separation container 24 via a solenoid valve 18 and a control valve 20. A heater device 19 mounted on the vapor separation container 24 is thus required only in exceptional cases. The oil is likewise admitted via a line 15 and a solenoid valve 17 into the lubrication connection 16, where the solenoid valve 17 holds back the oil reserve in the higher lying vapor separation container 21 at standstill.

What is claimed is:

1. Screw compressor apparatus for refrigerants with oils soluble in refrigerants, wherein a delivery flow is divided after a screw compressor in an oil separator under exit pressure into a gas flow and an oil flow, and the oil flow arrives at the screw compressor via a restrictor and an oil inlet, wherein before the restrictor a partial oil flow is branched off via a branch for the lubrication of bearings and/or shaft seals, which partial oil flow is led through a vapor separation container, which is connected on the gas side via a line to an intermediate pressure connection on the compression path of the screw compressor in order to feed the partial oil flow to a lubricating connection at the screw compressor with a pressure corresponding to the intermediate pressure.

2. Screw compressor apparatus in accordance with claim 1 wherein the vapor separation container is spatially arranged above the lubrication points at the screw compressor in order to use a head for the lubrication pressure.

3. Screw compressor apparatus in accordance with claim 2 wherein a blocking valve is arranged between the vapor separation container and the lubricating connection in order to prevent oil from running out of the vapor separation container in the stationary state.

4. Screw compressor apparatus in accordance with claim 1 wherein a blocking valve is arranged in the branch in order to prevent oil from flowing backward in the stationary state.

5. Screw compressor apparatus in accordance with claim 1 wherein a heater device is mounted at the vapor separation container to assist the vapor separation performance and prevents an enrichment of the oil with refrigerant in the stationary state.

6. Screw compressor apparatus in accordance with claim 1 wherein a throttle member is provided in the branch in order to limit the partial oil flow.

7. Screw compressor apparatus in accordance with claim 6 wherein a control valve is provided in the branch as throttle member in order to regulate the partial oil flow in the branch in accordance with a prespecified desired value.

8. Screw compressor apparatus in accordance with claim 1 wherein two parallel connection lines are provided between the vapor separation container and the lubricating connection, of which one has a delivery pump with a non-return valve and the other has a non-return valve in order to assist the transport of oil to the lubricating connection during start-up of the screw compressor.

9. Screw compressor with an apparatus in accordance with claim 1 further comprising an economizer connection as intermediate connection such as is provided for an intermediate infeed of a partial gas flow for multiple relaxation of the gas flow.

10. Screw compressor with an apparatus in accordance with claim 9 wherein the intermediate pressure connection has no connection to the suction space over the entire power range, even at extreme partial loading, in order to maintain the intermediate pressure necessary for the lubrication.

11. Screw compressor with an apparatus in accordance with claim 1, wherein the screw compressor has a shaft seal and possesses a drive-side bearing on the suction side.

* * * * *